United States Patent [19]

Hyler

[11] 3,971,146

[45] *July 27, 1976

[54] REENTRANT DRIVING ARRANGEMENT FOR SCRAPER ELEVATOR

[75] Inventor: John H. Hyler, Peoria, Ill.

[73] Assignee: Westinghouse Air Brake Company, Pittsburgh, Pa.

[ * ] Notice: The portion of the term of this patent subsequent to July 27, 1993, has been disclaimed.

[22] Filed: Mar. 14, 1975

[21] Appl. No.: 558,226

[52] U.S. Cl. ..... 37/8; 198/203; 74/572

[51] Int. Cl.[2] ..... B60P 1/36; B65G 23/00

[58] Field of Search ..... 37/8; 198/203; 74/572, 74/573, 413

[56] References Cited

UNITED STATES PATENTS

| | | | |
|---|---|---|---|
| 2,523,887 | 9/1950 | Thomson et al. | 198/203 |
| 2,965,217 | 12/1960 | Dommann et al. | 37/8 X |
| 3,076,540 | 2/1963 | Christian | 198/203 |
| 3,424,029 | 1/1969 | Horsch et al. | 37/8 X |
| 3,483,639 | 12/1969 | Eftefield et al. | 37/8 |
| 3,526,978 | 9/1970 | Jordan | 37/8 |
| 3,557,473 | 8/1968 | Grossklaus et al. | 37/8 |
| 3,559,312 | 2/1971 | Fox et al. | 37/8 |
| 3,668,794 | 6/1972 | Marquardt et al. | 37/8 |
| 3,738,031 | 6/1973 | Lott | 37/8 |
| 3,758,966 | 9/1973 | Miller | 37/8 |

*Primary Examiner*—E. H. Eickholt
*Attorney, Agent, or Firm*—Leydig, Voit, Osann, Mayer & Holt, Ltd.

[57] ABSTRACT

An elevator for loading a scraper bowl, the elevator having a frame which extends upwardly and rearwardly from a scraper blade and which has a set of flights mounted on endless chains. At the top of the frame is a chain drive shaft powered by a speed reduction gear box driven by an electric motor. The gear box is of flat, elongated configuration extending downwardly from the shaft in a position nested closely against one of the elevator frame elements, with both the inlet connection and the outlet connection of the gear box facing inwardly of the frame and with the motor occupying a "reentrant" position extending into the unused space between the runs of the conveyor chain. In the preferred form of the invention the elevator frame members are rigidly interconnected by tubular cross member, the tubular cross member being open-ended and the motor being telescoped therein occupying a fully recessed position protected from physical abuse and shielded from the soil and debris elevated by the flights. The thickness of the gear box is such that it extends outwardly beyond the flights only by an amount which is on the order of the thickness of the bowl side sheets, so that the gear box does not project substantially beyond the side sheets while nevertheless permitting the ends of the elevator flights to extend almost into engagement with the side sheets for efficient filling of the bowl and avoidance of leakage. In the preferred form of the invention the motor is rigidly mounted to the gear box, permitting the gear box and motor to be easily and quickly removed as a unit from the elevator frame when servicing is necessary.

13 Claims, 7 Drawing Figures

Fig. 1.
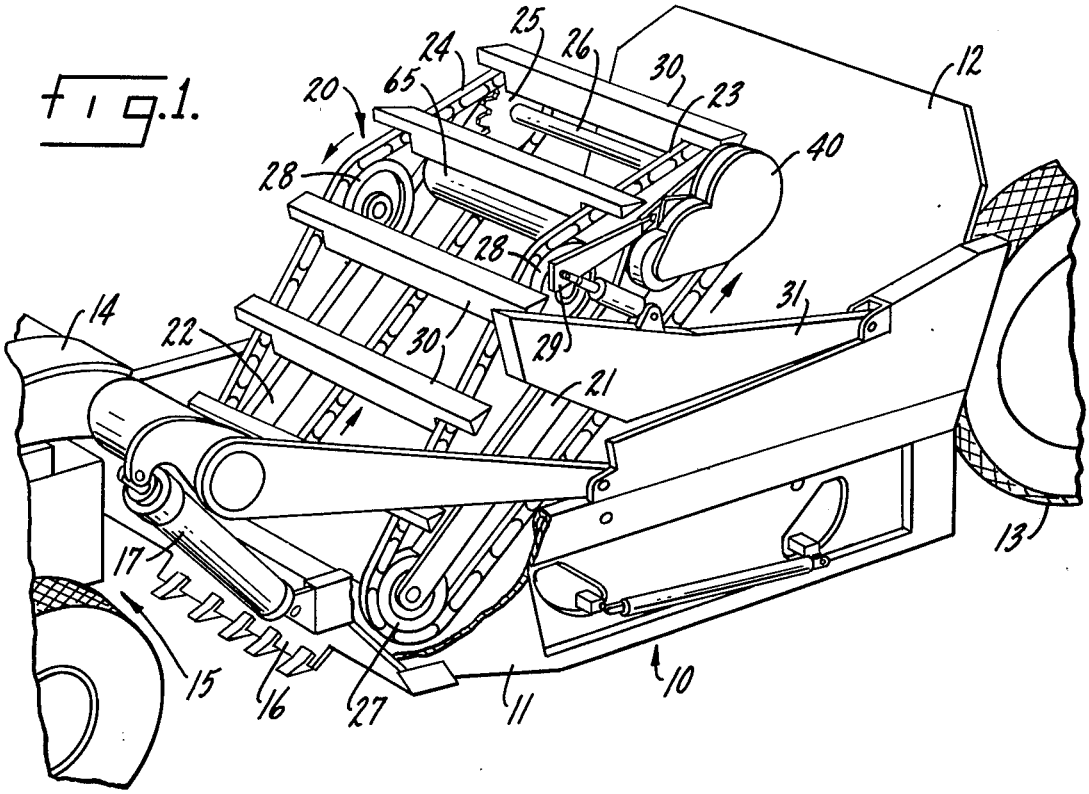
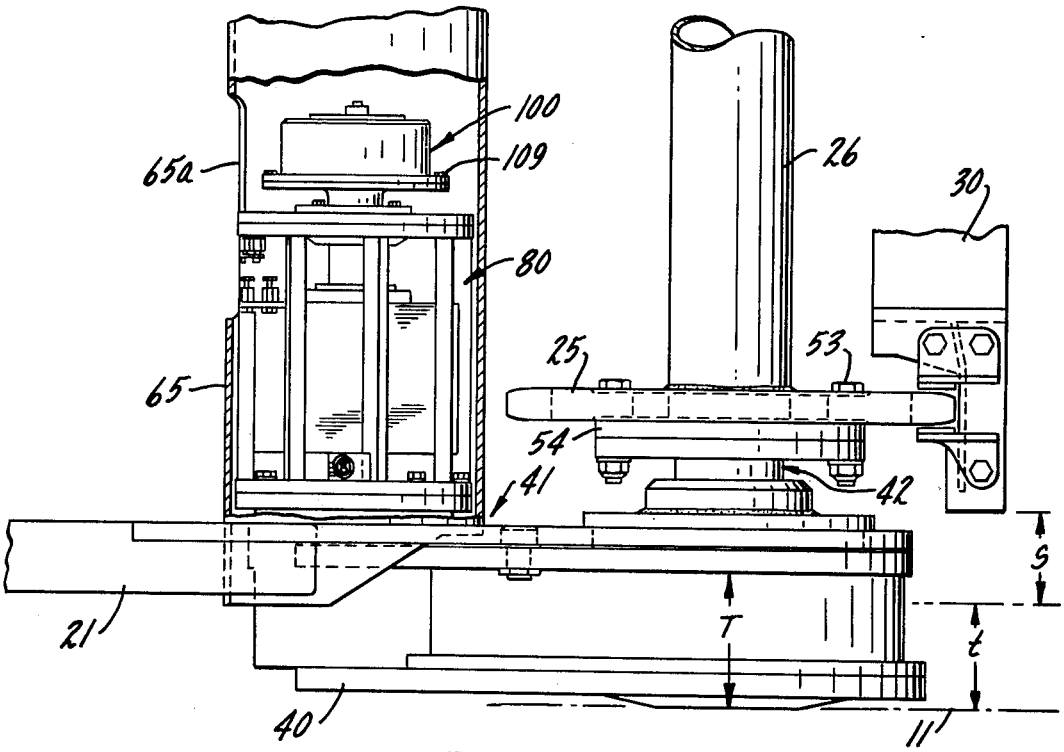
Fig. 2.

Fig. 5.
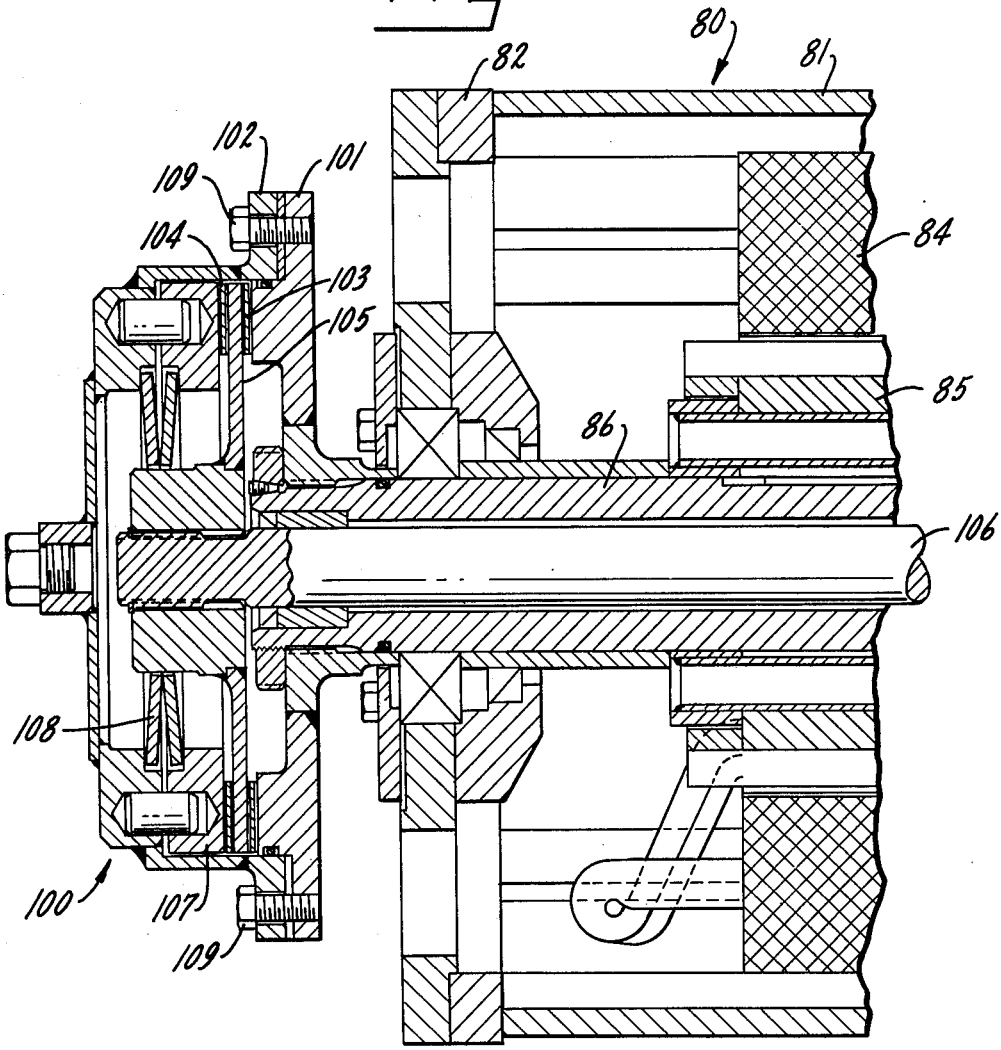
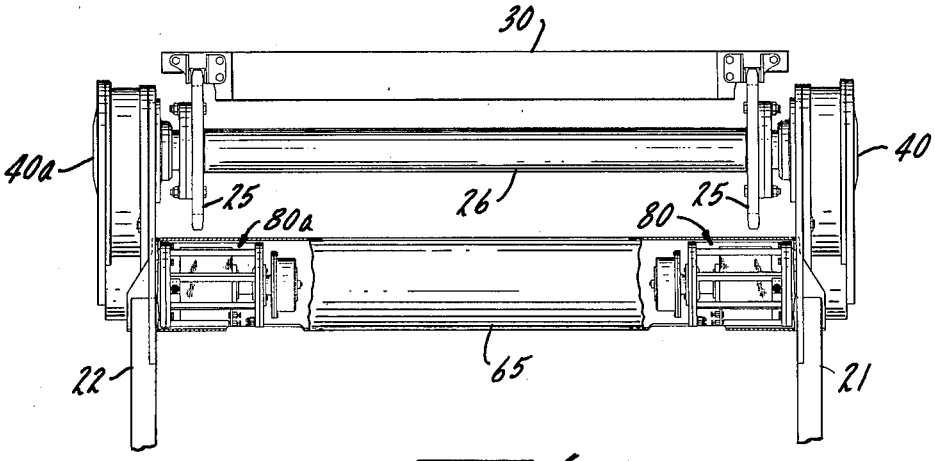
Fig. 6.

REENTRANT DRIVING ARRANGEMENT FOR SCRAPER ELEVATOR

This application is related to copending application Ser. No. 563,486, filed Mar. 31, 1975.

BACKGROUND OF THE INVENTION

The invention relates generally to an elevator for an earth moving scraper and more particularly to improved means for driving the elevator chains and the soil-propelling flights which are mounted on the chains.

Elevator drive systems have commonly employed an hydraulic motor having a flywheel and a speed reduction gear box. In some installations electric motors have been used. In addition, torque converters and slip couplings have sometimes been included in the drive train.

Earth moving elevators have also been mechanically powered from the prime mover or from an auxiliary engine, transmitting power through universal joints and drive shafts, plus suitable intermediate gear boxes as required, and eventually driving a main gear box at one side of the elevator.

Because of the space required for conventional elevator drive system components, the elevator flight width must be reduced, averaging, in a commercial scraper, only about 70 percent of the bowl width or about 62 percent of the scraper width. As might be expected, using an elevator of narrow width results in inefficient operation since the soil cannot be moved from the front to the back of the bowl progressively over the entire body width. Loading efficiency is further reduced since soil being conveyed up the slope tends to escape between the ends of the flights and the bowl side sheets, spilling down the slope at each side and being partially lost on the ground and partially recirculated again into the intake area of the elevator.

Moreover, the elevator is relied upon to retain the soil in the bowl during transport, and where there is a gap between the ends of the flights and the wall of the bowl an escape passage is provided resulting in leakage and scattering of dirt along the transport path.

Also a large gap between the flight ends and the wall of the bowl, particularly in the region of the blade base, results in inadequate cleaning of the bowl at time of dumping, particularly when handling clayey soils, so that "dead" material is carried on successive round trips thus reducing the material delivered in each trip.

Quite apart from distribution and retention of the soil within the bowl, a serious problem arises from the mismatch between the width of the strip of soil loosened by the blade and the elevator which is relied upon to transport the soil away from the region of the blade, resulting in failure to load the soil which is loosened at the blade ends.

Then too, there is the problem of wear and damage to the drive components. Where the elevator is of narrow width, the sprockets are inherently closer to the longitudinal center line adjacent the region of central heaping of the soil so that the sprockets and chains tend to run in the loaded material. Where the material is of an abrasive nature, wear of the moving parts may be extremely rapid. Moreover, where the chains and sprockets run in the loaded material there is serious risk that rocks and hard pieces of debris may be caught or wedged between chain and sprocket in the region of convergence to impose severe loads on the chain and drive system, resulting in sudden or incipient breakage requiring the machine to be taken out of service until a repair can be made. Other debris of a tough nature may be wound around the sprocket causing a build-up under the associated chain and imposing added resistance for the drive to overcome, to the point of stalling the elevator as well as straining the components and reducing their life expectancy.

Efforts have been made in the past to employ longer flights, notwithstanding the limitations imposed by the drive. For example, elevator motors or drive components, including gear boxes, have been extended in projecting position, cantilever fashion, beyond the overall width of the rest of the vehicle. However, this places the motor and drive components in a vulnerable position where they may be easily damaged by trees, rock banks and adjacent structures and also by other passing vehicles. Moreover, the overall width of the machine, being increased by the overhanging drive arrangement, requires increased roadway widths and door widths and increased shipping expense because of the increased cubic size of the vehicle or by the cost of disassembly in an effort to reduce such cubic size.

In lieu of mounting the motor and other drive elements in an outwardly projecting position, the drive sprockets have been moved more closely together, enabling the motor and gear box to be axially retracted and with the flight ends being extended closer to the bowl side sheets so that considerable overhand exists between the flight ends and the driving components which are adjacent to one of the sprockets. However, with the gear box and motor housing occupying an inwardly retracted position, under the overhanging flight ends, flight clearance is extremely limited so that material carried by the flights causes considerable wear to the housing and related attachments, particularly when handling the more abrasive materials. Also because of the small clearance, rocks and debris carried by the flights may be wedged between the flights and the housing, damaging these components and raising the likelihood of a jamming condition causing immediate failure requiring extensive shut-down. Moreover, moving the motor and gear box inwardly requires that the conveyor sprockets be more closely spaced, so that the chains and their sprockets must run buried in the abrasive material with correspondingly shortened life.

In still other elevator constructions the motor and gear box have been moved to a position between the chain sprockets. While this enables the sprockets and chains to be more widely spaced and reduces the degree of flight overhang, the close clearances give rise to the same problem of wear and incipient jamming.

Finally, for the purpose of avoiding overhang of the drive, designers have resorted to the expedient of offsetting the elevator toward one side of the bowl to gain space at the other side for the drive. This, as might be expected, reduces the loading efficiency and unbalances the load in the bowl with unfortunate effects upon weight distribution. Moreover, the offset results in a large space being left at one side through which leakage may occur both in loading and transport.

SUMMARY OF THE INVENTION

It is accordingly an object of the present invention to provide an elevator drive which avoids the vulnerabilities associated with the overhanging type of drive and which avoids the inefficiencies and aggravated wear and clearance (jamming) problems which have been inherent in the known alternative constructions.

Thus in accordance with the invention there is provided an elevator having widely spaced frame members and sprockets and flights which occupy substantially the entire width of the bowl, extending into close proximity to the bowl side sheets, reducing leakage, minimizing overhang of the flights beyond the chains, and enabling the chains and sprockets to operate free of the elevated soil and free of the wear which usually occurs when abrasive materials are being handled.

This is accomplished in the present invention by employing a gear box of elongated flat configuration which extends downwardly from the sprocket drive shaft along one of the frame members and which has a "thickness" which need not be substantially greater than the side sheet thickness. The gear box is further distinguished by having input and output connections both of which extend inwardly toward the scraper center line. The drive motor, which is connected to the input connection of the gear box, is extended in a "reentrant" position inwardly into the normally unused space between the chains, the motor preferably being rigidly mounted at right angles to the gear box to form a unitary drive assembly which can be readily installed and removed for inspection or service. Further in accordance with the invention a hollow cross tube extends horizontally between the elevator frame members for the purpose of coupling them rigidly together, with the motor being telescoped into the cross tube where it occupies a position fully protected from the action of stones, debris and abrasive materials conveyed by the flights. Moreover, the substantially unlimited axial length available within the cross tube permits use of high speed, high powered motors having a long, thin form factor, adequate space being available within the gear box to provide the necessary speed reduction, and permits use, where desired, of an unhoused, yet fully protected slip coupling at the remote end of the motor for protective purposes.

The result is an integrated and compact driving arrangement which permits the elevator flight assembly to be of optimum design for maximum loading efficiency, free of the compromises which have affected such designs in the past, so as to obtain maximum productivity from a given size of scraper-elevator.

BRIEF DESCRIPTION OF THE DRAWINGS

FIG. 1 is a simplied perspective view of an elevator employing the present invention;

FIG. 2 is a fragmentary view of the drive assembly, with the cross member broken away to reveal the drive motor;

FIG. 5 is a cross section through the friction slip clutch and adjacent portion of the motor looking along line 5—5 in FIG. 4; and FIG. 6 is a fragmentary view similar to FIG. 2 but showing use of two motors in the same cross member.

Figure 3:
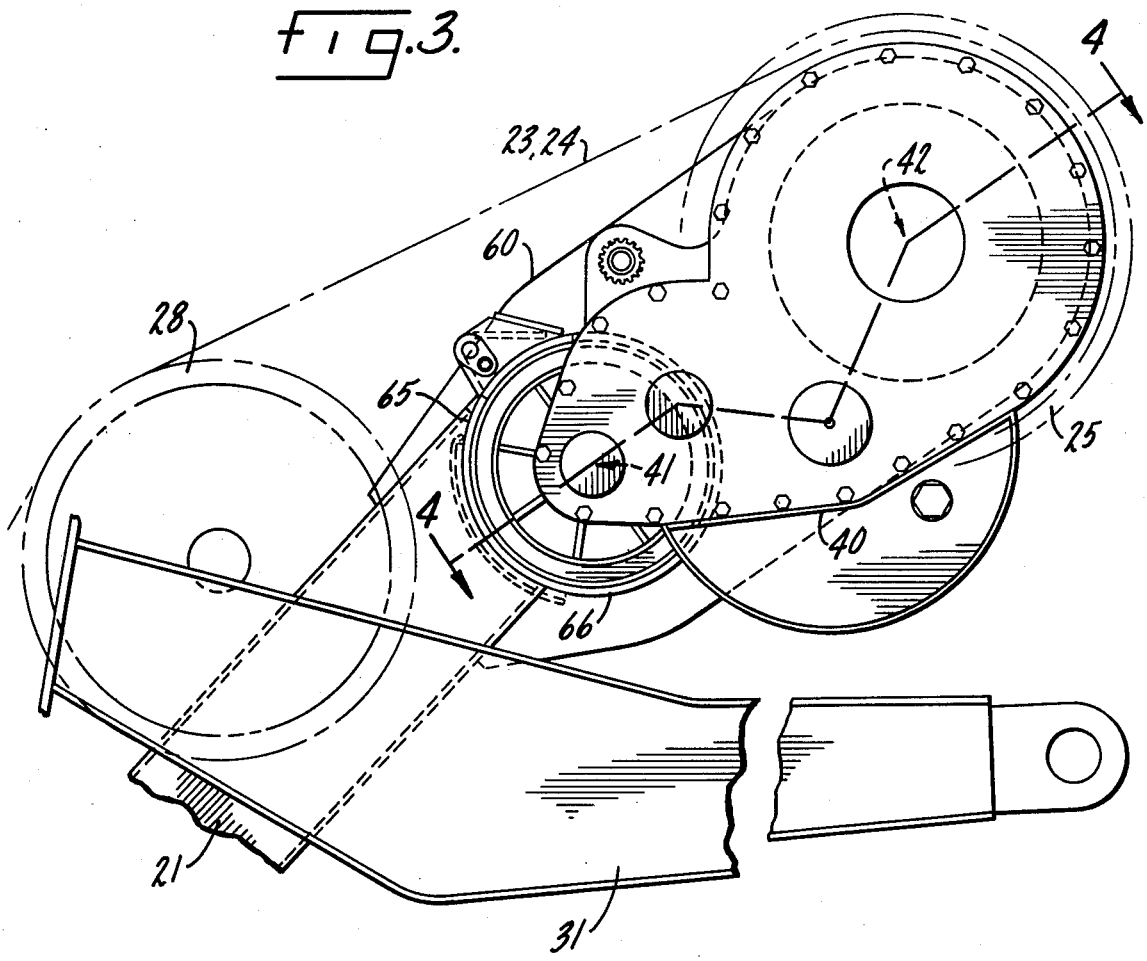
FIG. 3 is a fragmentary elevational view.

While the invention has been described in connection with a preferred embodiment, it will be understood that there is no intention to limit the invention to such embodiment, and it is intended, on the contrary, to cover the various alternative and equivalent constructions included within the spirit anc scope of the appended claims.

DETAILED DESCRIPTION OF THE PREFERRED EMBODIMENT

Referring now the drawings, there is disclosed a scrapper bowl 10 of open-fronted construction having side sheets 11 and a back 12 as well as a floor extending between the side sheets but which is not visible in the drawing. The bowl is supported at the rear upon ground wheels 13 and at the front by a draft frame 14 on the tractor 15. A scraper blade 16 digs into the ground to a depth which is determined by the adjustment of a pair of bowl hoist cylinders, one of which is shown at 17.

The elevator, generally indicated at 20, encloses the open front of the bowl, extending upwardly and rearwardly from the region of the blade. The elevator has a frame including longitudinal frame members 21, 22 mounting endless conveyor chains 23, 24. The chains are trained about sprockets 25 on a drive shaft 26 at the upper end, about rollers 27 at the lower end, and auxiliary idlers 28 at mid-position, the idlers being mounted on arms 29. The idlers 28 form a "hump" in the downward runs of chain, with the arms being held in extended position to maintain tension. For conveying the loosened soil into the bowl, transversely extending flights 30 are secured to the chains at spaced intervals. The elevator frame is swingably supported on the bowl on arms 31, only one of such arms being shown.

Figure 4:
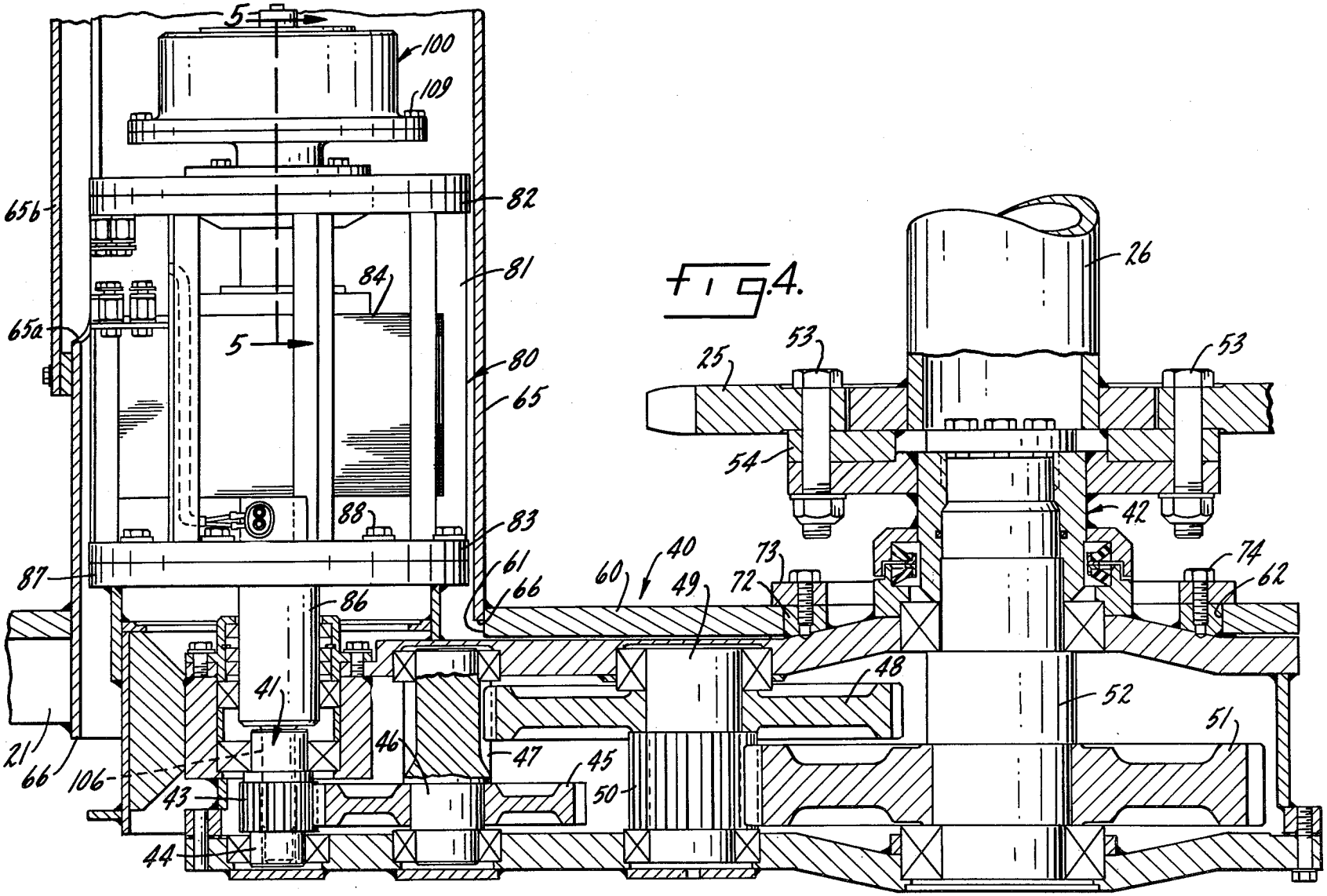
FIG. 4 is a section taken along the line 4—4 in FIG. 3.

For the purpose of powering the shaft 26, a drive train is provided including a gear box 40 having an input connection 41 and an output connection 42 parallel thereto. Interposed between the input connections is a train of speed reduction gears. The gear train includes a pinion 43 on a shaft 44 (FIG. 4). The pinion meshes with a gear 45 on a shaft 46 having an output pinion 47. The pinion 47, in turn, drives a gear 48 having a shaft 49 and pinion 50. Finally, the latter pinion drives a heavy duty gear 51 which is mounted on a large diameter shaft 52 which carries the output connection 42, the latter being in the form of a hub and circular mounting flange carrying the drive sprocket 25. The latter, which is preferably segmented, is secured by bolts 53, with an annular driving flange 54 sandwiched in between. By proper choice of relative pinion and gear size and choice of number of reduction stages, the overall gear reduction, from input to output, may be made as large a necessary, a reduction ratio of about 112:1 being employed in the illustrated embodiment.

It is one of the features of the construction that the gear box 40 is of elongated "flat" configuration, nesting compactly against the extended upper end of the longitudinal frame member 21. Preferably the longitudinal frame member 21 is of composite construction, with the lower portion being formed of a box, channel or I-beam and with an upper portion being in the form of an elongated flat supporting plate 60 having an input clearance opening 61 and an output clearance opening 62.

Figure 2A:
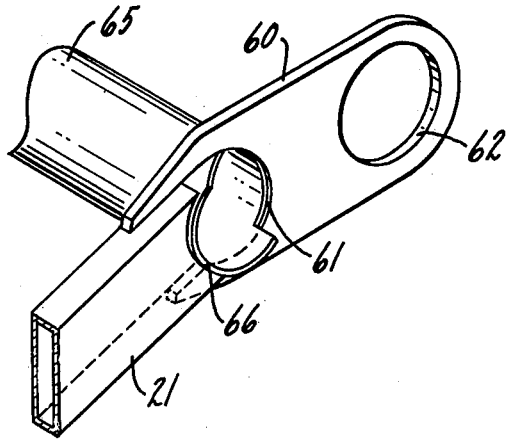
FIG. 2*a* is a fragmentary perspective showing the joint between frame member, cross tube and supporting plate.

For the purpose of providing transverse rigidification of the elevator frame, the longitudinal members 21, 22 of the frame, which are parallel to one another, are joined by a hollow tubular cross member 65 of relatively large diameter, a diameter which preferably equals or exceeds the cross sectional dimension of the frame members. The end of the tubular cross member, indicated at 66, which is open and accessible, is securely welded to both the frame member 21 and to the plate 60 (FIG. 2*a*), thereby rigidifying the joint between them. The plate 60 provides a strong extension for the frame member 21, and, being flat, elongated, and offset inwardly with respect to the member 21, provides a seating surface for compact nested reception of the "flat" gear box 40.

For mounting the gear box securely to the plate 60, the gear box is provided with a circular mounting ring 72 (FIG. 4) which is dimensioned to fit within the circular opening 62 in the plate, with the gear box being clamped in place by an annular retaining ring 73 held in place by a circle of clamping screws 74.

For the purpose of driving the input connection 41 of the gear box, a motor 80 is provided having a cylindrical frame 81 and end bells 82, 83 enclosing field structure 84. Journalled in the end bells is a rotor formed of an armature 85 on a shaft 86. For securing the motor at right angles to the gear box to make a unitary drive assembly, the gear box is provided with a mounting flange 87 to which the motor end bell 83 is fastened by means of a circle of mounting screws 88.

It is one of the features of the present invention that the flat gear box 40 has its inlet and outlet connections facing in the same direction, that is, inwardly with respect to the elevator, so that the motor 80 is "reentrantly" received in the normally unused space between the runs of the conveyor chains and preferably adjacent the idler rollers 28 when the space between the runs of chain is maximum. More particularly in accordance with the invention, the hollow tubular cross member 65 is open ended and coaxial with the gear box inlet connection, with the motor 80 being telescoped within the cross member so that it occupies a fully recessed and fully protected position.

A friction slip clutch is preferably interposed between the motor shaft 86 and the gear box inlet connection 41, the clutch being set to provide a drive connection which resists slippage during normal loading of the flights, including anticipated peak loads, but which permits slippage upon blockage of the drive shaft when a flight engages a solid obstruction causing a predetermined level of torque to be exceeded. In carrying out the invention the motor shaft is hollow and the clutch is of the type having concentric input and output shafts, dynamically balanced, and with the output shaft of the clutch extending through the hollow motor shaft into splined engagement with the input connection 41 on the gear box. Thus, referring particularly to FIG. 5 of the drawings, the clutch assembly indicated at 100 has an annular stator which consists of an annular inner portion 101 which is secured to the hollow motor shaft and an outer or housing portion 102. These portions carry opposed clutching shoes 103, 104. Relatively rotatable between the clutching shoes is a clutch disc or output element 105 which is secured to a relatively thin output shaft 106 which extends through the motor shaft 86 and the end of which is spline-connected to the input 41 of the gear box.

Means are provided for varying the static pressure applied between the shoes 103, 104 to the disc 105. This variation is brought about by mounting the shoe 104 on an annular keyed insert 107, with a spring 108 in the form of a pair of Bellville washers being interposed between the cap member 102 and the annular insert 107. The amount of axial spring force is established and adjusted by a circle of shims and clamping screws 109, the screws 109 being uniformly tightened to the point that no relative slippage of the disc 105 will occur during all normal operating peaks of the elevator; however, should an elevator flight be seriously obstructed by a boulder, large branch or other impediment, causing abrupt deceleration of the motor armature 85, which acts as a flywheel, the predetermined level of torque will tend to be exceeded causing slippage at the clutch faces, thereby to limit the torque which is applied to the gear box to the predetermined level while simultaneously dissipating the kinetic energy which is stored in the rotating armature. Preferably an access opening 65*a* is provided in the wall of the tubular cross member 65, enclosed by a cover plate 65*b*, to permit inspection of the motor and slight adjustment of the adjusting screws 109 which may be required from time to time. It will be apparent that the tubular cross member, in addition to protecting the motor, fully encloses the clutch assembly 100 so that it is at all times freely rotatable without possibility of interference.

Under normal conditions kinetic energy which is stored in the armature 85 and in the rotating clutch assembly 100 is fully effective, without slippage, to augment the motor torque in overcoming peaks of loading. To increase the available kinetic energy, the clutch asembly 100, and particularly the housing portion 102 thereof, may be made more massive so that it has a higher degree of rotational inertia or flywheel action. The energy which is stored in the rotating flywheel and clutch assembly, upon sudden decelaration caused by blockage of a flight, may intentionally exceed the torque capability of the gear box. However, by use of the present invention, the actual amount of torque which may be transmitted through the shaft 106 which feeds the input of the gear box is reliably limited by the adjustment of the slip clutch to that level which is within the safe capability of the gear box.

Not only is the motor protected against physical blows in its reentrant location, but it is also fully shielded against entry of dirt and other foreign material transported by the flight, thereby permitting use of a more open type ventilated motor distinguished by compactness and low cost.

It will be apparent that the main design factor limiting the utility of previous constructions, namely, the cantilevered overhang of motor and associated drive elements in a highly exposed position, has been eliminated, and, indeed, the present tubular accommodation insures that axial length is no longer a design limitation. This, combined with the high stepdown ratios obtainable by multi-staging in the flat elongated gear box, opens the door for the first time to use of powerful high speed electric motors of long, thin form factor. Instead of a liability, by reason of speed and dimension, use of such a motor is, in the present construction, turned into an asset.

Regardless of the length of the motor, servicing is quick and easy: The bolts 53 securing the sprocket 25 and shaft 26 to the output flange 42 are removed, followed by unscrewing of the screws 74 and retainer ring 73 which secure the assembly to the mounting plate 60, following which the combined motor-gear box assembly may be axially withdrawn and a replacement unit substituted within a matter of minutes. Sufficient radial clearance preferably exists between the motor and inner wall of the tubular member to avoid contact or binding and to insure that the motor is supported by the gear box. If desired, the clearance may be increased beyond that shown to facilitate ventilation of the motor for cooling purposes.

Sufficient rotational inertia to overcome normal peaks of load will be provided by the armature 85 in commercially available types of motors and by the rotating friction clutch assembly 100. However in the event that a motor having a lightweight armature is used, or an hydraulic motor providing less rotational inertia at the motor output shaft 86, an auxiliary flywheel element (not shown) may be mounted upon such shaft without departing from the present invention, keeping in mind that such flywheel may be made intentionally oversized without hazard to the stepdown drive gearing. Thus the term "flywheel armature" as used herein refers to a motor armature having substantial inertia capable of storing sufficient kinetic energy to overcome normal peaks in the operating load either with or without a supplemental flywheel element.

The use of the term "of flat configuration" as applied to the gear box refers to the fact that the gears are strung out in a series, rather than being axially stacked, resulting in a housing which has a substantially greater length than it has axial thickness reducing overhang to nearly zero. Indeed, the axial thickness T of the gear box is only a small amount greater than the thickness *t* of side sheet (FIG. 2) with which it is vertically alined. This permits the bringing of the flight ends into close proximity to the side sheet, being separated therefrom by only a narrow clearance "space" S, so that efficiency is maximum while leakage of soil is sharply reduced.

Since the elevated soil tends to mound up centrally in the bowl, the widely spaced sprockets and chains, which are located near the side sheets, need not operate submerged, reducing wear between these elements to a minimum and reducing the likelihood that a rock or other debris might become wedged between them. At the same time, because of the central motor location, flight clearance problems of the type which can result in jamming and catastrophic failure are entirely obviated.

In the embodiment described above a motor and gear box assembly is employed at one end of the drive shaft 26. However, it is one of the features of the present invention that two such assemblies may be utilized in the form of mirror images of one another at the upper ends of the frame members 21, 22 and with the motors extending mutually inwardly into the opposite open ends of the cross member 65 in symmetrical, fully recessed and protected positions. This is shown in FIG. 6 in which the cooperating gear box is indicated at 40*a* and its motor at 80*a*. Employing motors and gear boxes which are substantially identical to one another, each contributes half of the total power requirements. This permits the driving power to be doubled with only minor structural modification to adapt the elevator to difficult conditions or where more rapid elevation of the soil is required. Not only are both of the motors telescoped into the same cross member, but each motor may be of long thin configuration without utilizing all of the space within the cross member.

I claim as my invention:

1. For use with a tractive vehicle, an earth moving machine including a receptacle in the form of a wheeled bowl having vertical side sheets, a floor and an open front with a scraper blade spanning the open front, a draft frame for securing the bowl to the vehicle, an elevator having a pair of interconnected frame members inclined upwardly and rearwardly from the region of the blade, a pair of endless conveyor chains having spaced upward and downward runs, the frame member having sprockets at the upper end and rollers at the lower end for supporting the chains, the sprockets being mounted on a drive shaft extending between the frame members and whch has a driving end, the chains having a series of transverse flights for conveying soil loosened by the blade upwardly and rearwardly into the bowl, a gear box of elongated flat configuration positioned closely against the frame member which is at the driving end of the shaft and extending downwardly from the latter, the gear box having input and output connections on the same side at its respective lower and upper ends interconnected by a set of reduction gears, the output connection being connected to the drive shaft, and a drive motor having its shaft connected to the input connection of the gear box, the drive motor extending reentrantly into the empty space between the runs of chain.

2. For use with a tractive vehicle, an earth moving machine including a receptacle in the form of a wheeled bowl having vertical side sheets, a floor and an open front with a scraper blade spanning the open front, a draft frame for securing the bowl to the vehicle, an elevator having a pair of interconnected frame members inclined upwardly and rearwardly from the region of the blade, a pair of endless conveyor chains having upward and downward runs, the frame members having sprockets at the upper end and rollers at the lower end for supporting the chains, as well as auxiliary idlers at midposition for maintaining the runs widely spaced from one another, the sprockets being mounted on a drive shaft extending between the frame members and which has a driving end, the chains having a series of transverse flights for conveying soil loosened by the blade upwardly and rearwardly into the bowl, a gear box of elongated flat configuration positioned closely against the frame member which is at the driving end of the shaft and extending downwardly from the latter, the gear box having input and output connections on the same side at its respective lower and upper ends interconnected by a set of reduction gears, the output connection being connected to the drive shaft, and a drive motor having its shaft connected to the input connection of the gear box, the drive motor extending reentrantly between the runs of chain adjacent the idlers and centered in a positon widely spaced from the flights and the materials transported thereby.

3. The combination as claimed in claim 1 in which the chains and sprockets are located at the ends of the flights with wide axial spacing and in which the tips of the flights extend into proximity to the respective side sheets.

4. The combination as claimed in claim 1 in which the gear box has a thickness on the general order of thickness of the associated side sheet and in which the gear box lies in a position vertically above and generally alined with such side sheet.

5. The combination as claimed in claim 1 in which the motor is rigidly mounted upon the gear box and in which the gear box is detachably secured to the elevator frame so that the motor and gear box may be removed and replaced as a unit in the event that servicing becomes necessary.

6. For use with a tractive vehicle, an earth moving machine including a receptacle in the form of a wheeled bowl having vertical side sheets, a floor, and an open front with a scraper blade spanning the open front, a draft frame for securing the bowl to the vehicle, an elevator having a pair of frame members inclined upwardly and rearwardly from the region of the blade, a pair of endless conveyor chains having spaced upward and downward runs, the frame members having sprockets at the upper end and rollers at the lower end for supporting the chains, the sprockets being mounted on a drive shaft extending between the frame members and having a driving end, the chains having a series of transverse flights for conveying soil loosened by the blade upwardly and rearwardly into the bowl, the frame member which is at the driving end terminating in a flat elongated supporting plate, a flat elongated gear box mounted on the supporting plate and extending downwardly therealong, the gear box having parallel input and output connections facing in the direction of the mounting plate and interconnected by a set of reduction gears, the output connection being directly connected to the drive shaft, a drive motor of relatively long and thin form factor secured at right angles to the gear box with the motor shaft being connected to the input connection, and a tubular cross member extending transversely between the frame members substantially at the junction between the supporting plate and its associated frame member, the tubular cross member being open ended for telescoped reception of the motor in a protected position, the sprockets and chains being widely spaced adjacent the respective ends of the flights, and the tips of the flights lying closely adjacent to the side sheets of the bowl for elevation and retention of the soil over substantially the full width of the bowl.

7. For use with a tractive vehicle, an earth moving machine including a receptacle in the form of a wheeled bowl having vertical side sheets, a floor, and an open front with a scraper blade spanning the open front, a draft frame for securing the bowl to the vehicle, an elevator having a pair of frame members inclined upwardly and rearwardly from the region of the blade, a pair of endless conveyor chains having upward and downward runs, the frame members having sprockets at the upper end and rollers at the lower end for supporting the chains, the sprockets being mounted upon a drive shaft extending between the frame members and having a driving end, the chains having a series of transverse flights for conveying soil loosened by the blade upwardly and rearwardly into the bowl, a horizontally arranged tubular cross member structurally interconnecting the frame members between the runs of chain and at a level substantially below the drive shaft, a gear box of elongated flat configuration positioned closely against the frame member which is at the driving end of the shaft and extending downwardly therefrom, the gear box having input and output connections on the same side at its respective lower and upper ends interconnected by a set of reduction gears, the output connection being directly connected to the drive shaft, and a drive motor having its shaft connected to the input connection of the gear box, the spacing between the input and output connections of the gear box being such that the drive motor is substantially centered on the axis of the tubular cross member and telescoped into the cross member in a fully recessed and protected position.

8. The combination as claimed in claim 7 in which the motor is flange-mounted upon the lower end of the gear box and in which detachable means are provided for securing the gear box to the associated frame member so that the motor is substantially totally supported by the gear box while being protectively enclosed by the cross member.

9. The combination as claimed in claim 8 in which a sealable access opening is provided in the cross member for servicing the motor and any associated drive elements in normal driving position.

10. The combination as claimed in claim 7 in which the tubular cross member has a diameter which is on the order of cross sectional dimension of the frame members, the tubular cross member having an open end which extends beyond the frame member at the driving end to provide access for the telescoped insertion of the motor into the cross member.

11. For use with a tractive vehicle, an earth moving machine including a receptacle in the form of a wheeled bowl having vertical side sheets, a floor and an open front with a scraper blade spanning the open front, a draft frame for securing the bowl to the vehicle, an elevator having a pair of frame members inclined upwardly and rearwardly from the region of the blade, one of the frame members having an extension in the form of a flat supporting plate at its upper end, a tubular cross member of large diameter structurally interconnecting the frame members, the cross member being located at the junction between the frame member and the supporting plate and securely welded to each of them to form a rigid structural joint, a pair of endless conveyor chains having spaced upward and downward runs, the members frame having sprockets at the upper end and rollers at the lower end for supporting the chains, the sprockets being mounted on a drive shaft extending between the frame members and having a driving end terminating at the supporting plate, the chains having a series of transverse flights for conveying soil loosened by the blade upwardly and rearwardly into the bowl, a gear box of elongated flat configuration positioned with flatly against the supporting plate and extending downwardly therelong, the gear box having input and output connections on the inner side at its respective lower and upper ends interconnected by a set of reduction gears, the output connection being connected to the drive shaft, and a drive motor secured at right angles to the gear box at the input connection, the drive motor being of cylindrical shape and dimensioned for full telescopic reception in the tubular cross member.

12. The combination as claimed in claim 11 in which the supporting plate is inwardly offset with respect to the associated frame member, being in general alinement with the inner surface of the latter to provide nested accommodation for the flat gear box.

13. For use with a tractive vehicle, an earth moving machine including a receptacle in the form of a wheeled bowl having vertical side sheets, a floor, and an open front with a scraper blade spanning the open front, a draft frame for securing the bowl to the vehicle, an elevator having a pair of frame members inclined upwardly and rearwardly from the region of the blade, a pair of endless conveyor chains having upward and downward runs, the frame members having drive sprockets at the upper end and rollers at the lower end for supporting the chains, the sprockets being mounted upon a drive shaft extending between the frame members, the chains having a series of transverse flights for conveying soil loosened by the blade upwardly and rearwardly into the bowl, a horizontal open-ended tubular cross member structurally interconnecting the frame members between the runs of chain and at a level substantially below the drive shaft, gear boxes of elongated flat configuration positioned closely against the frame members at the ends of the shaft and extending downwardly therefrom, the gear boxes each having opposed input and output connections at the respective lower and upper ends interconnected by a set of reduction gears, the output connections being directly connected to the ends of the drive shaft, and drive motors having shafts respectively connected to the input connections of the gear boxes and extending mutually inwardly, the spacing between the input and output connections of the gear boxes being such that the drive motors are substantially centered on the axis of the tubular cross member and telescoped into open ends of the cross member in symmetrical, fully recessed and protected positions.

* * * * *